US011993435B2

(12) United States Patent
Liu et al.

(10) Patent No.: US 11,993,435 B2
(45) Date of Patent: May 28, 2024

(54) CHILD-RESISTANT SEALING POUCH

(71) Applicant: QINGDAO DEJILI PACKAGING TECHNOLOGY CO., LTD., Qingdao (CN)

(72) Inventors: Chao Liu, Qingdao (CN); Cuntian Liu, Qingdao (CN)

(73) Assignee: QINGDAO DEJILI PACKAGING TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 17/589,560

(22) Filed: Jan. 31, 2022

(65) Prior Publication Data

US 2022/0153488 A1 May 19, 2022

Related U.S. Application Data

(63) Continuation-in-part of application No. PCT/CN2021/071713, filed on Jan. 14, 2021.

(30) Foreign Application Priority Data

Nov. 18, 2020 (CN) ..... 202022682243.1

(51) Int. Cl.
*B65D 50/06* (2006.01)
*B65D 33/25* (2006.01)

(52) U.S. Cl.
CPC ..... *B65D 50/06* (2013.01); *B65D 33/2541* (2013.01); *B65D 2215/00* (2013.01)

(58) Field of Classification Search
CPC . B65D 50/06; B65D 33/2541; B65D 2215/00
(Continued)

(56) References Cited

U.S. PATENT DOCUMENTS 4,878,763 A * 11/1989 Ausnit ..... B65D 33/2508 24/585.12
5,272,794 A * 12/1993 Hamatani ..... A44B 19/16 24/DIG. 39

(Continued)

FOREIGN PATENT DOCUMENTS

CN 110446665 A * 11/2019 ..... B65D 33/2533
CN 111217030 A 6/2020

(Continued)

OTHER PUBLICATIONS

Machine translation of CN-110446665-A.*

*Primary Examiner* — Jes F Pascua
(74) *Attorney, Agent, or Firm* — Bayramoglu Law Offices LLC

(57) ABSTRACT

A child-resistant sealing pouch is provided. The sealing pouch includes a pouch body and a seal bar provided at a top of the pouch body, where two ends of the seal bar are fixed on two sides of the pouch body; the seal bar includes a first closing piece and a second closing piece; the first closing piece and the second closing piece are respectively provided with a first locking piece and a second locking piece which are buckled for sealing; an upper side of the first closing piece is provided with a first upper extension piece; the first upper extension piece is thermally connected to one inner side of the pouch body; an upper side of the second closing piece is provided with a second upper extension piece, and a lower side of the second closing piece is provided with a second lower extension piece.

7 Claims, 6 Drawing Sheets

(58) Field of Classification Search
USPC ..... 383/63
See application file for complete search history.

(56) References Cited

U.S. PATENT DOCUMENTS

| | | | | |
|---|---|---|---|---|
| 7,914,208 | B2 | 3/2011 | Sprehe | |
| 2012/0045151 | A1 | 2/2012 | Eouzan | |
| 2022/0281657 | A1* | 9/2022 | Tidwell | B65D 50/04 |

FOREIGN PATENT DOCUMENTS

| | | | |
|---|---|---|---|
| CN | 211168057 | U | 8/2020 |
| EP | 3693288 | A1 | 8/2020 |
| WO | 2020137736 | A1 | 7/2020 |

* cited by examiner

CHILD-RESISTANT SEALING POUCH

CROSS REFERENCE TO THE RELATED APPLICATIONS

This application is a continuation-in-part application of International Application No. PCT/CN2021/071713, filed on Jan. 14, 2021, which is based upon and claims priority to Chinese Patent Application No. 202022682243.1, filed on Nov. 18, 2020, the entire contents of which are incorporated herein by reference.

TECHNICAL FIELD

The present invention relates to the technical field of sealing pouches, and in particular, to a child-resistant sealing pouch.

BACKGROUND

Reclosable sealing pouches come in a variety of zipper formats from sliding bar zippers to press-to-close zippers. They are typically made of polyethylene (PE), with examples such as low-density polyethylene (LDPE) and linear low-density polyethylene (LLDPE), polyolefin (PO) or ethyl vinyl acetate (EVA), which is molded by film blowing and hot-cut. Due to a series of advantages, the sealing pouches are widely used for product packaging, storing food, accessories, medicines, cosmetics, postal products, etc., and have now become an indispensable daily necessity.

The sealing structure of the sealing pouch is typically a seal bar provided at the top of the sealing pouch to form a buckle seal. To open the sealing pouch, both sides of the top of the sealing pouch are pulled outward and the entire seal bar at the top of the sealing pouch is pulled apart. This is the most common and simplest way to open the sealing pouch, which is easy for both adults and children. If the sealing pouch contains items that should be kept away from children, such as small and sharp jewelry, blades, inedible powder, granules or medicines, these dangerous items are prone to scratch children or to be eaten by children after the sealing pouch is easily opened.

SUMMARY

In order to solve the problem of the prior art, the present invention provides a child-resistant sealing pouch. It takes skill to open the sealing pouch, which can effectively prevent children from opening the sealing pouch and accessing the contents therein, thereby avoiding danger caused to the children.

The objective of the present invention may be achieved by the following technical solution: a child-resistant sealing pouch includes a pouch body and a seal bar provided at a top of the pouch body, where two ends of the seal bar are fixed on two sides of the pouch body; the seal bar includes a first closing piece and a second closing piece; the first closing piece and the second closing piece are respectively provided with a first locking piece and a second locking piece which are buckled for sealing; an upper side of the first closing piece is provided with a first upper extension piece; the first upper extension piece is thermally connected to one inner side of the pouch body; an upper side of the second closing piece is provided with a second upper extension piece, and a lower side of the second closing piece is provided with a second lower extension piece; the second lower extension piece is folded upward and thermally connected to the other inner side of the pouch body; and the second upper extension piece is not thermally fixed to any inner side of the pouch body.

Preferably, a first heat-seal adhesive piece at the first upper extension piece and a heat-seal adhesive piece at the second lower extension piece may be level in height.

Preferably, the second upper extension piece may be narrower than the first upper extension piece.

Preferably, a lower side of the first closing piece may be not provided with any lower extension piece.

Preferably, the first locking piece may be located on the first closing piece; the first locking piece may include at least two first grooves; side walls of the first grooves away from the top of the pouch body may be respectively bent toward insides of the first grooves to form first inner hooks; the second locking piece may be located on the second closing piece, the second locking piece may include at least two second grooves; side walls of the second grooves close to the top of the pouch body may be respectively bent toward insides of the second grooves to form second inner hooks; and when the first grooves may be respectively buckled with the second grooves, the first inner hooks may be respectively hooked with the second inner hooks.

Preferably, a number of the first grooves, arranged next to each other, is two, and a number of the second grooves, arranged next to each other, is two.

Preferably, the top of the pouch body may be heat-sealed; slots may be respectively provided on two sides of the top; and the slots may be located on a lower side of a heat seal of the top.

A correct approach to open the sealing pouch of the present invention is as follows. The heat seal at the extreme end of the top is first tore off. In order to save effort, either one of the two slots can be tore off as a tear slit to expose the seal bar. Then, one hand pinches the first upper extension piece, and the other hand pulls the second upper extension piece of the second closing piece apart, and simultaneously pinches the second upper extension piece and the second lower extension piece of the second closing piece. The two hands pull outward at the same time to tear apart the first locking piece and the second locking piece, thereby completely opening the top.

In the ordinary opening approach, both sides of the top or the first upper extension piece of the first closing piece and the second lower extension piece of the second closing piece are pinched and pulled outward to open the top. The stress point of the first closing piece is on a side of the first locking piece closest to the top, and the stress point of the second closing piece is on a side of the second locking piece farthest from the top. The stress points on both sides of the seal bar are misaligned. Therefore, when the first upper extension piece of the first closing piece and the second lower extension piece of the second closing piece are pulled into a plane of 180°, the pulling force on the seal bar is along a sealing surface. In addition, since the first inner hooks and the second inner hooks form a mutual hooking structure, it is extremely difficult for children to open the sealing pouch, which makes the sealing pouch truly child-resistant.

When the sealing pouch is opened by pulling the second upper extension piece and the second lower extension piece of the second closing piece to be overlapped, and then pinching and tearing them outward, the positions of the stress points of the first closing piece and the second closing piece are consistent. Since there is no first inner hook on the side of each of the first grooves close to the top, the seal bar can be easily pulled apart from top to bottom. This kind of operation is dexterous for adults, and adults may still need to read the instructions before opening the sealing pouch. Therefore, the present invention can effectively prevent children from opening the top of the sealing pouch, thereby avoiding danger.

The present invention has the following comprehensive effects. The present invention has a simple and reasonable structure and is convenient to use. The first upper extension piece of the first closing piece is thermally connected to the pouch body, and the second lower extension piece of the second closing piece is folded upward and thermally connected to the pouch body. After the two closing pieces are buckled, it is difficult to open the top only by pinching and tearing the two sides of the pouch body outward, because the stress points of the two closing pieces do not overlap. Therefore, the sealing pouch can be prevented from being opened by children themselves. In addition, in the correct opening approach of the sealing pouch, the second upper extension piece and the second lower extension piece of the second closing piece are pulled to be overlapped, and then pinched and torn outward. As the stress points of the two closing pieces overlap, the sealing pouch can be opened easily. The correct opening approach is dexterous for adults, who may still need to read the instructions before opening the sealing pouch. Therefore, it is extremely difficult for children to open the sealing pouch.

BRIEF DESCRIPTION OF THE DRAWINGS

In the drawings, the same parts are marked by the same reference numerals, and the drawings are not drawn to scale.

DETAILED DESCRIPTION OF THE EMBODIMENTS

Figure 1:
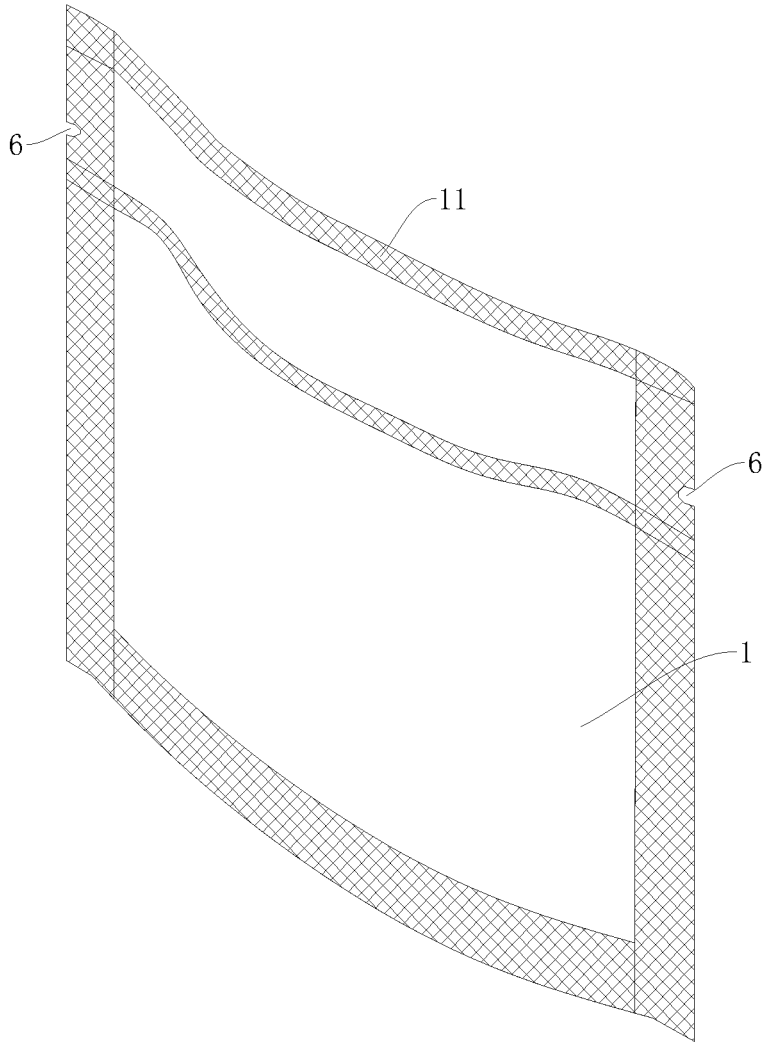
FIG. 1 is a three-dimensional view of a pouch body according to an embodiment of the present invention.
Figure 2:
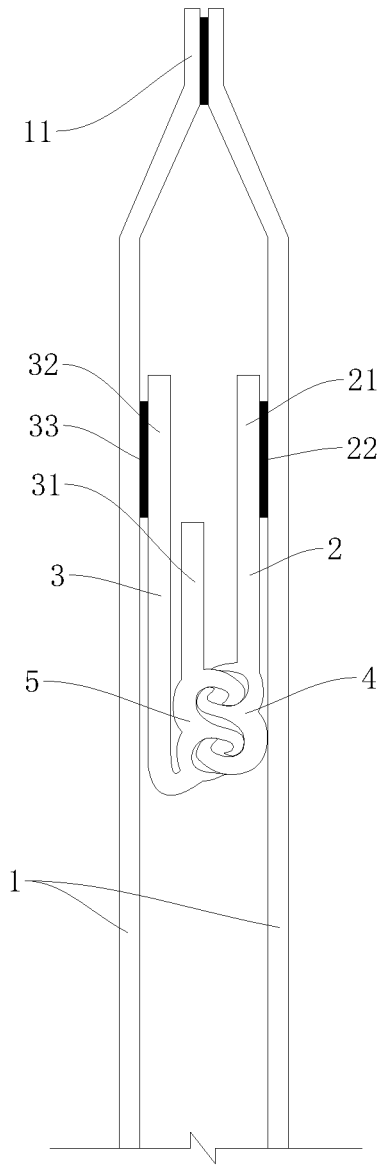
FIG. 2 is a sectional view of a seal bar according to the embodiment of the present invention.
Figure 3:
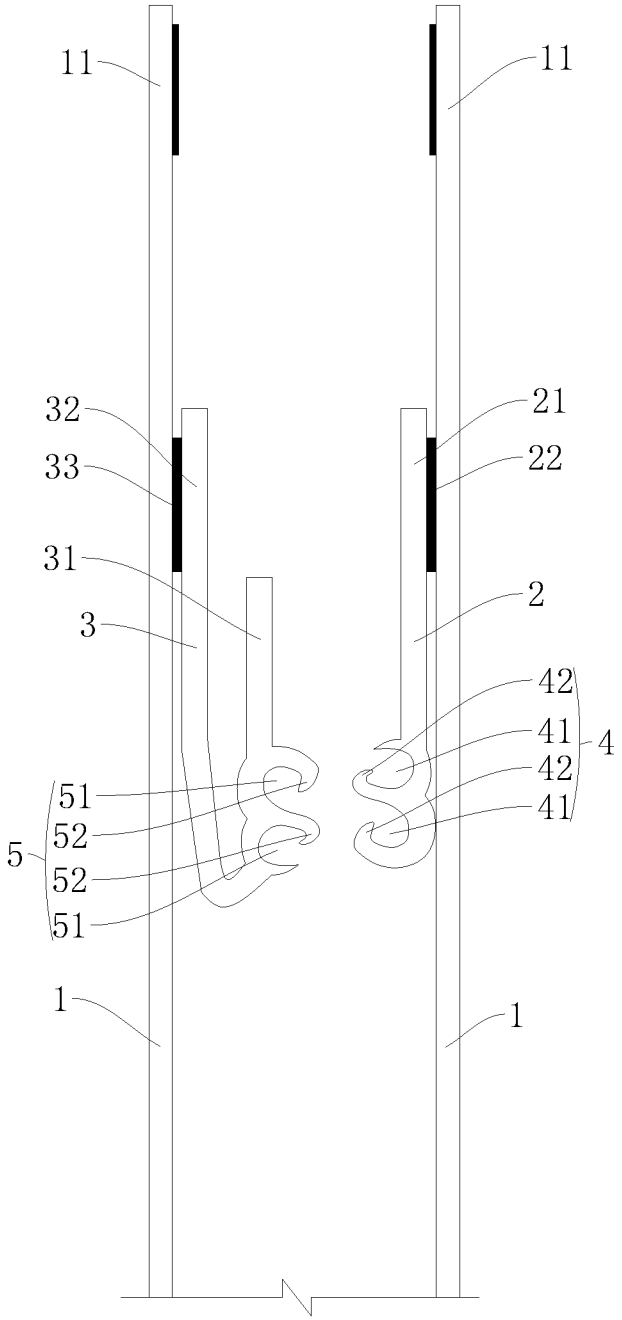
FIG. 3 shows the seal bar of the pouch body in an open state according to the embodiment of the present invention.

The present invention is described in further detail below with reference to drawings and embodiments.

Embodiment

A child-resistant sealing pouch includes a pouch body 1 and a seal bar provided at a top 11 of the pouch body 1. Two ends of the seal bar are fixed on two sides of the pouch body 1. The seal bar includes a first closing piece 2 and a second closing piece 3. The first closing piece 2 and the second closing piece 3 are respectively provided with a first locking piece 4 and a second locking piece 5 which are buckled for sealing. An upper side of the first closing piece 2 is provided with a first upper extension piece 21. The first upper extension piece 21 is thermally connected to one inner side of the pouch body 1, but a lower side of the first closing piece 2 is not provided with any lower extension piece. An upper side of the second closing piece 3 is provided with a second upper extension piece 31, and a lower side of the second closing piece 3 is provided with a second lower extension piece 32. The second lower extension piece 32 is folded upward and thermally connected to the other inner side of the pouch body 1. A first heat-seal adhesive piece 22 at the first upper extension piece 21 and a heat-seal adhesive piece 33 at the second lower extension piece 32 are level in height. The second upper extension piece 31 is not thermally fixed to any inner side of the pouch body 1, and the second upper extension piece 31 is narrower than the first upper extension piece 21.

Further, in this embodiment, the first locking piece 4 is located on the first closing piece 2. The first locking piece 4 includes two first grooves 41. The two first grooves 41 are arranged next to each other and are provided with a cross section in the shape of an Arabic numeral "3". Side walls of the first grooves 41 away from the top 11 of the pouch body 1 are respectively bent toward insides of the first grooves 41 to form first inner hooks 42. The second locking piece 5 is located on the second closing piece 3. The second locking piece 5 includes two second grooves 51. Side walls of the second grooves 51 close to the top 11 of the pouch body 1 are respectively bent toward insides of the second grooves 51 to form second inner hooks 52. In this embodiment, cross-sectional shapes of the second locking piece 5 and the first locking piece 4 are centrally symmetrical. To seal, the first grooves 41 are respectively buckled with the second grooves 51, and the first inner hooks 42 are respectively hooked with the second inner hooks 52.

In addition, in order to prevent the seal bar from being dirty during transportation and to further seal the sealing pouch tightly, the top 11 of the pouch body 1 is heat-sealed. In order to facilitate the tearing of the heat seal at the top 11, slots 6 are respectively provided on two sides of the top 11. The slots 6 are located on a lower side of a heat seal of the top 11.

Figure 4:
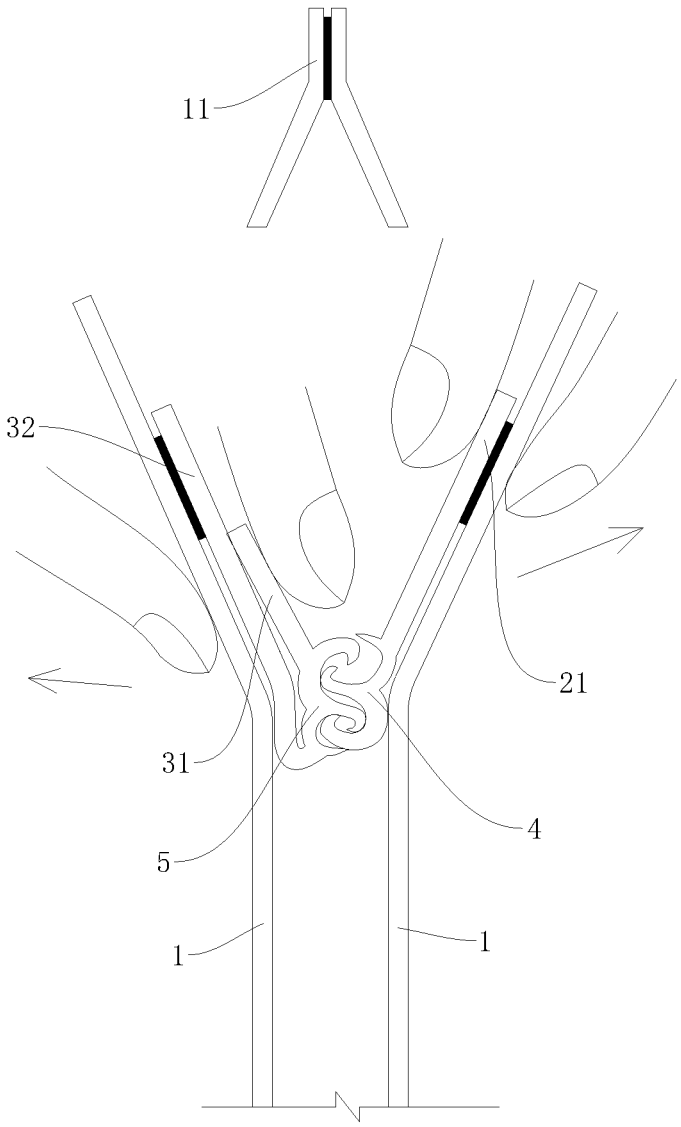
FIG. 4 shows a dexterous opening approach according to the embodiment of the present invention.

A correct approach to open the sealing pouch of the embodiment of the present invention is as follows. In a dexterous opening approach shown in FIG. 4, the heat seal at the extreme end of the top 11 is first tore off. In order to save effort, either one of the two slots 6 can be tore off as a tear slit to expose the seal bar. Then, one hand pinches the first upper extension piece 21 of the first closing piece 2, and the other hand pulls the second upper extension piece 31 of the second closing piece 3 apart, and simultaneously pinches the second upper extension piece 31 and the second lower extension piece 32 of the second closing piece 3. The two hands pull outward at the same time to tear apart the first locking piece 4 and the second locking piece 5, thereby completely opening the top 11.

Figure 5:
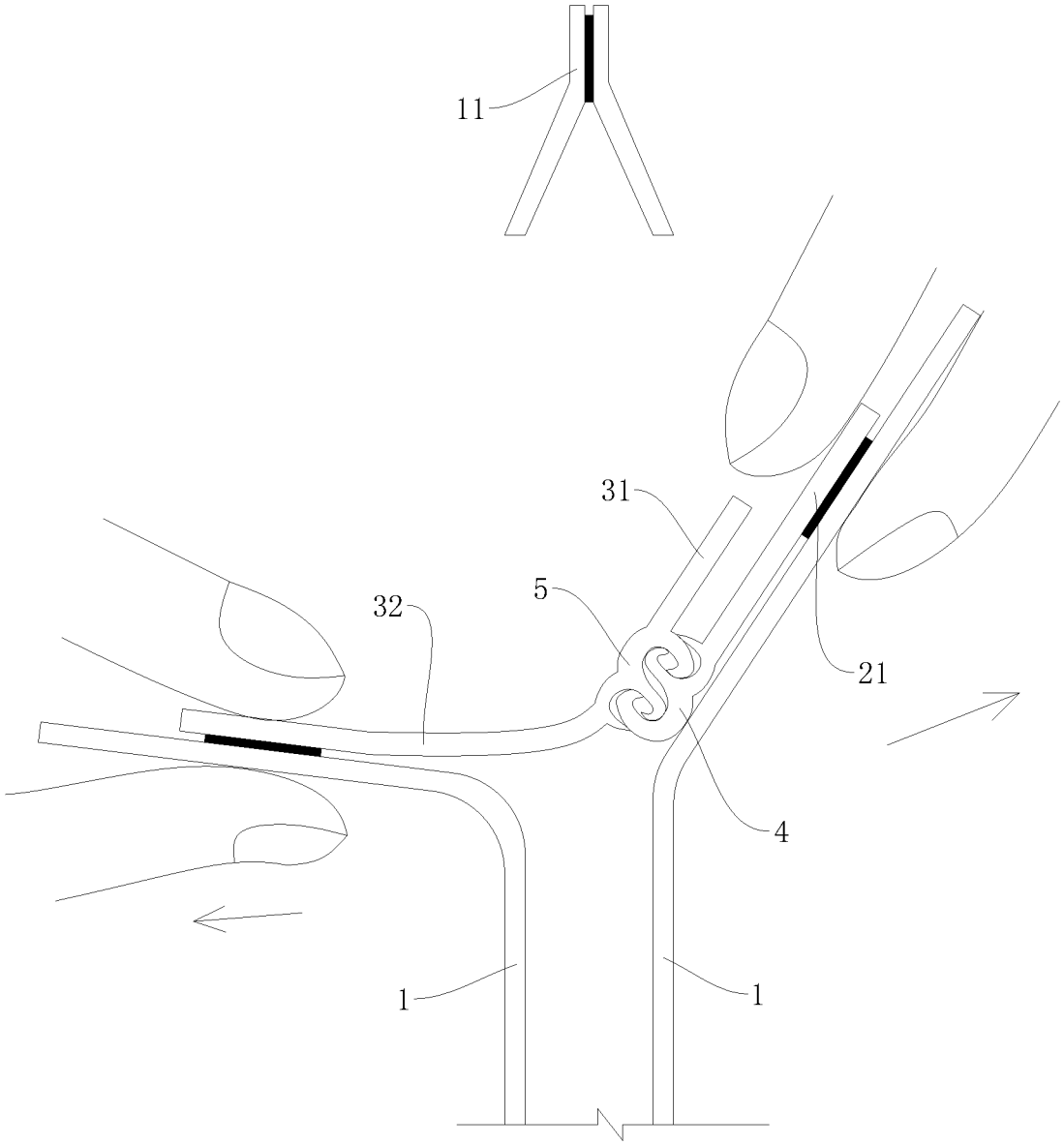
FIG. 5 is a first schematic view of an ordinary opening approach according to the embodiment of the present invention.
Figure 6:
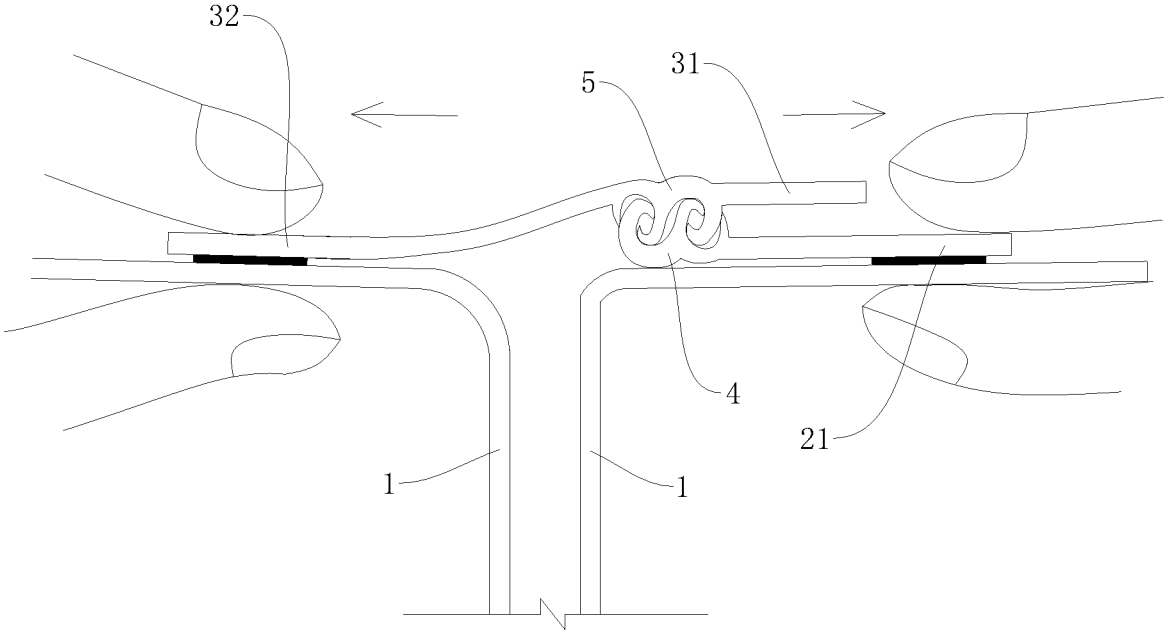
FIG. 6 is a second schematic view of the ordinary opening approach according to the embodiment of the present invention.

In an ordinary opening approach as shown in FIG. 5, both sides of the top 11 or the first upper extension piece 21 of the first closing piece 2 and the second lower extension piece 32 of the second closing piece 3 are pinched and pulled outward to open the top 11. The stress point of the first closing piece 2 is on a side of the first locking piece 4 closest to the top 11, and the stress point of the second closing piece 3 is on a side of the second locking piece 5 farthest from the top 11. The stress points on both sides of the seal bar are misaligned. Therefore, when the first upper extension piece 21 of the first closing piece 2 and the second lower extension piece 32 of the second closing piece 3 are pulled into a plane of 180°, as shown in FIG. 6, the pulling force on the seal bar is along a sealing surface. In addition, since the first inner hooks 42 and the second inner hooks 52 form a mutual hooking structure, during the tearing process, the hooking tightness of the first inner hooks 42 and the second inner hooks 52 increases with the tearing strength. Therefore, it is extremely difficult for children to open the sealing pouch through the ordinary opening approach, which makes the sealing pouch truly child-resistant.

When the sealing pouch is opened by pulling the second upper extension piece 31 and the second lower extension piece 32 of the second closing piece 3 to be overlapped, and then pinching and tearing them outward, the positions of the stress points of the first closing piece 2 and the second closing piece 3 are consistent, and both are at the side closest to the top 11. Since there is no first inner hook 42 on the side of each of the first grooves 41 close to the top 11, the seal bar can be easily pulled apart from top to bottom. This kind of operation is dexterous for adults, and adults may need to read the instructions to open the sealing pouch. Therefore, the present invention can effectively prevent children from opening the top 11 of the sealing pouch by themselves, thereby avoiding danger.

The embodiment of the present invention has the following comprehensive effects. The present invention has a simple and reasonable structure and is convenient to use. The first upper extension piece 21 of the first closing piece 2 is thermally connected to the pouch body 1, and the second lower extension piece 32 of the second closing piece 3 is folded upward and thermally connected to the pouch body 1. After the two closing pieces are buckled, it is difficult to open the top 11 only by pinching and tearing the two sides of the pouch body 1 outward, because the stress points of the two closing pieces do not overlap. Therefore, the sealing pouch can prevent children from opening the top 11 by themselves. In addition, in the correct opening approach of the sealing pouch, the second upper extension piece 31 and the second lower extension piece 32 of the second closing piece 3 are pulled to be overlapped, and then pinched and torn outward. As the stress points of the two closing pieces overlap, the sealing pouch can be opened easily. The correct opening approach is dexterous for adults, who may still need to read the instructions before opening the sealing pouch. Therefore, it is extremely difficult for children to open the sealing pouch.

The structures, scales and sizes shown in the specification are merely intended to match the content disclosed herein for the understanding and reading of those skilled in the art. They are not intended to limit the implementation conditions of the present invention, so they have no technical significance. Any modification to the structure, change in the proportional relationship or adjustment in the size should still fall within the scope of the technical content disclosed in the present invention without affecting the effects and objectives that can be achieved by the present invention. Meanwhile, the terms such as "upper", "lower", "left", "right", "central" and "a/an" mentioned herein are merely employed for ease of description, and not intended to limit the scope of the present invention, and the changes or adjustments in the relative relationship of these terms should be deemed as falling within the scope of the present invention in case of no substantial alteration of the technical contents.

Although the present invention is described with reference to the preferred embodiments, the protection scope of the present invention is not limited there-to. Therefore, any technical solution falling within the scope of the claims should fall within the protection scope of the present invention. Without departing from the scope of the present invention, various improvements may be made to the present invention and the components therein may be replaced with equivalents. In particular, as long as there is no structural conflict, the technical features in the embodiments may be combined in any way.

What is claimed is:

1. A child-resistant sealing pouch, comprising a double-face pouch body and a seal bar provided at a top of the double-face pouch body, wherein two ends of the seal bar are sealed and fixed on two sides of the double-face pouch body; the seal bar comprises a first closing piece and a second closing piece; wherein the first closing piece and the second closing piece are respectively provided with a first locking piece and a second locking piece, wherein the first locking piece and the second locking piece are buckled for sealing; an upper side of the first closing piece is provided with a first upper extension piece, but a lower side of the first closing piece is not provided with any lower extension piece; the first upper extension piece is thermally connected to a first inner side of the double-face pouch body; an upper side of the second closing piece is provided with a second upper extension piece, and a lower side of the second closing piece is provided with a second lower extension piece; the second lower extension piece is folded upward and thermally connected to a second inner side of the double-face pouch body; the second upper extension piece is not thermally fixed to any one of the first inner side and the second inner side of the double-face pouch body; the first locking piece is located on the first closing piece; the first locking piece comprises at least two first grooves; side walls of the at least two first grooves away from the top of the double-face pouch body are respectively bent toward insides of the at least two first grooves to form first inner hooks; a prong of the first locking piece closest to the first upper extension forming a downward curve without a hook; a prong of the first locking piece farthest from the first upper extension forming a upward curve with a hook; the second locking piece is located on the second closing piece; the second locking piece comprises at least two second grooves; a prong of the second locking piece closest to the second upper extension piece forming a downward curve with a hook; a prong of the second locking piece farthest from the second upper extension piece forming a upward curve without a hook; side walls of the at least two second grooves close to the top of the double-face pouch body are respectively bent toward insides of the at least two second grooves to form second inner hooks; the at least two first grooves are configured to be respectively buckled with the at least two second grooves, the first inner hooks are respectively hooked with the second inner hooks; the first upper extension piece of the first closing piece and the second lower extension piece of the second closing piece are configured to be pulled into a plane of 180° to generate a pulling force on the seal bar along a sealing surface, which increases a hooking tightness of the first inner hooks and the second inner hooks with a tearing strength;

wherein the second upper extension piece and the second lower extension piece of the second closing piece are configured to be pulled until they overlap in order for the sealing pouch to be opened by pinching and tearing outward, and wherein when the second upper extension piece and the second lower extension piece of the second closing piece are pulled to be overlapping, a portion of the first locking piece closest to an opening of the sealing pouch and a portion of the second locking piece closest to the opening of the sealing pouch are unbuckled so that a first inner hook and a second inner hook closest to the opening of the sealing pouch may be separated without resistance.

2. The child-resistant sealing pouch according to claim 1, wherein a first heat-seal adhesive piece at the first upper extension piece and a second heat-seal adhesive piece at the second lower extension piece are level in height.

3. The child-resistant sealing pouch according to claim 1, wherein the second upper extension piece is narrower than the first upper extension piece.

4. The child-resistant sealing pouch according to claim 3, wherein a number of the at least two first grooves, arranged next to each other, is two, and a number of the at least two second grooves, arranged next to each other, is two.

5. The child-resistant sealing pouch according to claim 4, wherein the top of the double-face pouch body is heat-sealed; slots are respectively provided on two sides of the top; and the slots are located on a lower side of a heat seal of the top.

6. The child-resistant sealing pouch according to claim 1, wherein the at least two first grooves are arranged next to each other and are provided with a cross section in the shape of an Arabic numeral "3", and cross-sectional shapes of the second locking piece and the first locking piece are centrally symmetrical.

7. The child-resistant sealing pouch according to claim 1, wherein when the first upper extension piece of the first closing piece and the second lower extension piece of the second closing piece are pulled into a plane of 180°, two stress points, one on each side of the seal bar, are configured to be misaligned, to increase a difficulty of opening the pouch.

* * * * *